US011503863B2

(12) United States Patent
Hendrix et al.

(10) Patent No.: US 11,503,863 B2
(45) Date of Patent: Nov. 22, 2022

(54) ANATOMICAL SUPPORTIVE SOCK WITH BREATHABLE PROTECTIVE SOLE

(71) Applicant: Parasole Advanced Recovery, LLC, San Francisco, CA (US)

(72) Inventors: Anthony D. Hendrix, San Francisco, CA (US); Stephanie L. Brown, San Francisco, CA (US)

(73) Assignee: FLY KYTIN CORP., San Francisco, CA (US)

( * ) Notice: Subject to any disclaimer, the term of this patent is extended or adjusted under 35 U.S.C. 154(b) by 172 days.

(21) Appl. No.: 16/638,519

(22) PCT Filed: Aug. 13, 2018

(86) PCT No.: PCT/US2018/046480
§ 371 (c)(1),
(2) Date: Feb. 12, 2020

(87) PCT Pub. No.: WO2019/036357
PCT Pub. Date: Feb. 12, 2019

(65) Prior Publication Data

US 2021/0123171 A1 Apr. 29, 2021

Related U.S. Application Data

(60) Provisional application No. 62/544,797, filed on Aug. 12, 2017.

(51) Int. Cl.
*A41B 11/02* (2006.01)
*A43B 1/04* (2022.01)

(52) U.S. Cl.
CPC ..... *A41B 11/02* (2013.01); *A43B 1/04* (2013.01); *D10B 2501/043* (2013.01)

(58) Field of Classification Search
CPC .. D04B 1/26; D04B 1/265; A43B 1/04; A43B 3/101; A43B 3/10; A41B 11/02;
(Continued)

(56) References Cited

U.S. PATENT DOCUMENTS 4,575,954 A * 3/1986 Bye ..... A61F 5/0111 2/240
4,645,466 A * 2/1987 Ellis ..... B63B 32/45 441/74

(Continued)

FOREIGN PATENT DOCUMENTS

EP 3155917 A1 4/2017

*Primary Examiner* — Danny Worrell
(74) *Attorney, Agent, or Firm* — Hayes Soloway PC

(57) ABSTRACT

A footwear device is disclosed herein that includes a knitted outer sock with an anatomical sole attached to its external bottom surface. The anatomical sole includes a raised arch support region and may, in some embodiments, include a plurality of apertures extending from a top surface of the sole through to a bottom surface of the sole. In other embodiments, however, the anatomical sole may be free from apertures. The anatomical sole may be shaped to curve upward along one or more of its edges (e.g., on a medial side and on a lateral side). In these and other embodiments, the anatomical sole may curve upward in a heel region to wrap around a heel area of the outer sock. An inner sock may optionally be positioned within the outer sock to provide additional cushioning and support.

26 Claims, 6 Drawing Sheets

(58) Field of Classification Search
CPC ..... A41B 11/08; A41B 11/10; A41B 2400/60; A41B 2500/10; D10B 2501/043
See application file for complete search history.

(56) References Cited

U.S. PATENT DOCUMENTS

| | | | | |
|---|---|---|---|---|
| 4,926,568 | A * | 5/1990 | Coffman | A43B 1/04 36/101 |
| 5,092,347 | A * | 3/1992 | Shaffer | A61F 13/064 128/892 |
| 5,157,791 | A | 10/1992 | Woodson et al. | |
| 5,483,703 | A | 1/1996 | Williams | |
| 6,880,268 | B2 * | 4/2005 | Chen | A43B 3/128 36/43 |
| 7,434,336 | B2 * | 10/2008 | Kosted | A43B 1/0081 36/10 |
| 8,056,149 | B2 * | 11/2011 | Duclos | A43B 23/07 2/239 |
| 8,205,271 | B2 * | 6/2012 | Canci | A41B 11/02 2/239 |
| 9,532,624 | B2 * | 1/2017 | Lap | B29D 35/04 |
| 10,051,918 | B2 * | 8/2018 | Dombrow | A43B 23/028 |
| 10,342,267 | B2 * | 7/2019 | Habert | A43B 3/101 |
| 2006/0021112 | A1 | 2/2006 | Roser et al. | |
| 2007/0204482 | A1 | 9/2007 | Gibson-Collinson | |
| 2011/0010964 | A1 | 1/2011 | Hardy et al. | |
| 2015/0181979 | A1 | 7/2015 | Gaither | |
| 2015/0230546 | A1 | 8/2015 | Zasloff | |
| 2015/0245686 | A1 | 9/2015 | Cross | |
| 2016/0044985 | A1 | 2/2016 | Lien | |

* cited by examiner

ANATOMICAL SUPPORTIVE SOCK WITH BREATHABLE PROTECTIVE SOLE

CROSS-REFERENCE TO RELATED APPLICATIONS

This application claims priority to U.S. Provisional Patent Application Ser. No. 62/544,797, filed Aug. 12, 2017, the contents of which are incorporated by reference herein.

FIELD OF THE DISCLOSURE

The present disclosure relates to footwear devices and, more particularly, to a knitted sock having an anatomical sole attached thereto as well as related methods of manufacture and use.

BACKGROUND

Various types of footwear devices are known. Some footwear devices, such as shoes, sneakers, boots, and sandals are customized for fitting particular features unique to a left foot or a right foot. Such footwear devices are often used for outdoor activities. Other types of footwear devices, such as socks and slippers, may be used interchangeably on a left foot or a right foot and are typically designed for indoor use or, in the case of socks, use inside of another type of footwear.

SUMMARY

The disclosed footwear devices include features to support the anatomical structure and natural form of a foot by adding support, traction, and protection of an outsole to a sock, while maintaining the comfort, compression, moisture-wicking, breathability, and other properties of a sock. The surface contour and built-in arch support of the anatomical sole provides relief by reducing strain, fatigue, and tissue stress in the arch region on the medial side of the foot. The anatomical sole of the disclosed footwear devices also provides improved traction on slippery surfaces and protects the knitted sock from the abrasion and fraying typically associated with sock wear.

The presently disclosed footwear devices include a knitted outer sock with an anatomical sole attached to its external bottom surface. The anatomical sole includes a raised arch support region and may, in some embodiments, include a plurality of apertures extending from a top surface of the sole through to a bottom surface of the sole. In other embodiments, however, the anatomical sole may be free from apertures. The anatomical sole may be shaped to curve upward along one or more of its edges (e.g., on a medial side and on a lateral side). In these and other embodiments, the anatomical sole may curve upward in a heel region to wrap around a heel area of the outer sock. An inner sock may optionally be positioned within the outer sock to provide additional cushioning and support. Also, in select embodiments, the outer sock may be knitted to include a region with increased compression relative to other regions of the outer sock. The region of increased compression may be located on a bottom middle surface of the outer sock and may extend from a medial side to a lateral side of the outer sock.

The presently disclosed footwear devices provide several advantages compared to traditional compression socks or orthotics. For example, the disclosed footwear devices offer comfort and compression in key areas for fit and provide functional support in the arch region and midfoot. The disclosed footwear devices are also anatomically supportive and breathable. The disclosed anatomical sole may also provide traction, minimize slipping, and also protect the outer sock against fraying and abrasion.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
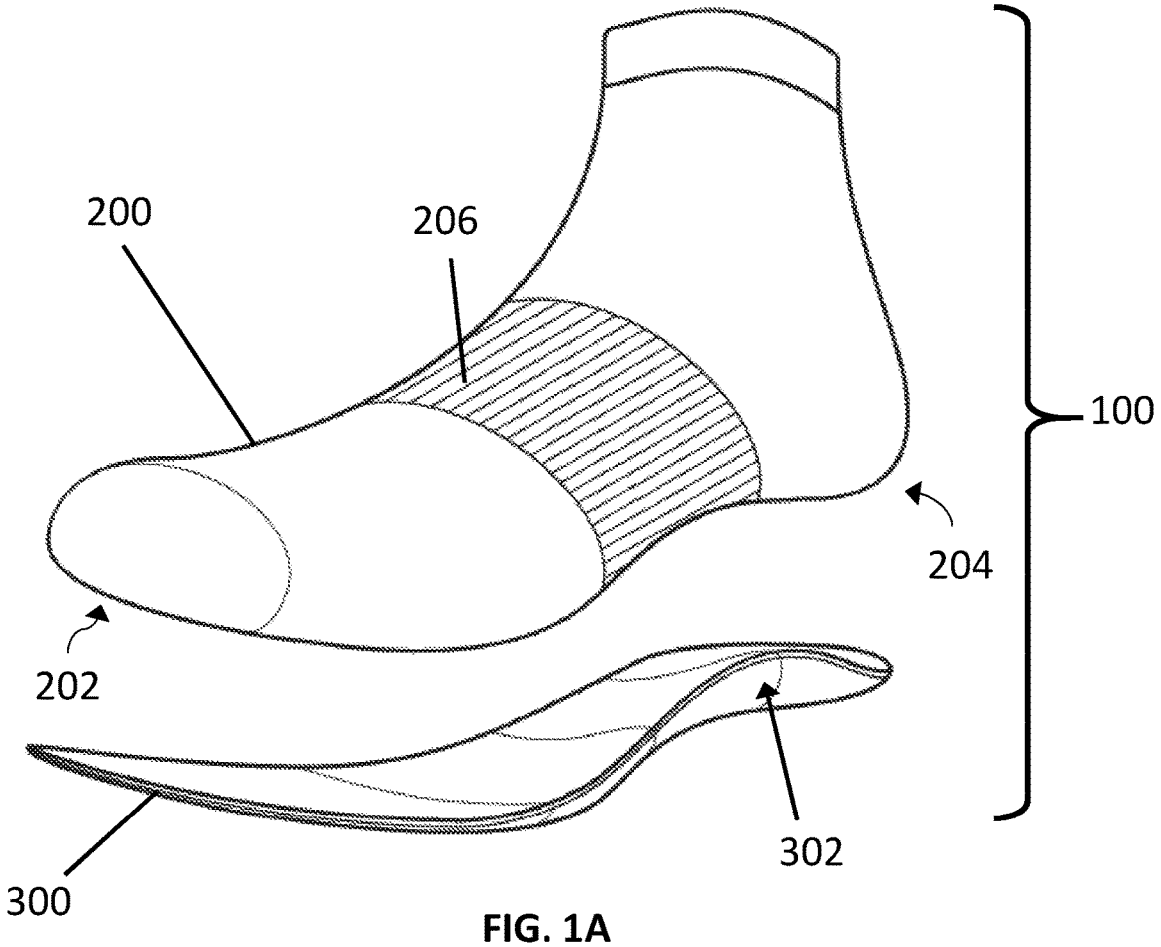
FIG. 1A illustrates an exploded view of an exemplary footwear device having an outer sock and an anatomical sole, in accordance with some embodiments of the subject disclosure.

As will be appreciated, the figures are not necessarily drawn to scale or intended to limit the disclosure to the specific configurations shown. For instance, while some figures generally indicate straight lines, right angles, and smooth surfaces, an actual implementation of the disclosed devices may have less than perfect straight lines, right angles, and smooth surfaces. In other words, the figures are provided merely to show some possible example structures. Additionally, for purposes of clarity, not every component may be labelled in every figure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated in light of this disclosure, the accompanying drawings are not intended to be drawn to scale or to limit the described embodiments to the specific configurations shown.

DETAILED DESCRIPTION

A footwear device formed of a knitted outer sock with an anatomical sole attached to its external bottom surface is disclosed. The anatomical sole includes a raised arch support region and may, in some embodiments, include a plurality of apertures extending from a top surface of the sole through to a bottom surface of the sole. However, in other embodiments, the anatomical sole may be free from apertures. The anatomical sole may be shaped to curve upward along one or more of its edges (e.g., on a medial side and on a lateral side). In these and other embodiments, the anatomical sole may curve upward in a heel region to wrap around a heel area of the outer sock. An inner sock may optionally be positioned within the outer sock to provide additional cushioning and support. Also, in select embodiments, the outer sock may be knitted to include a region with increased compression relative to other regions of the outer sock. The region of increased compression may be located on a bottom middle surface of the outer sock and may extend from a medial side to a lateral side of the outer sock. Numerous configurations and variations will be apparent to one skilled in the art upon consideration of the subject disclosure.

General Overview

Figure 1B:
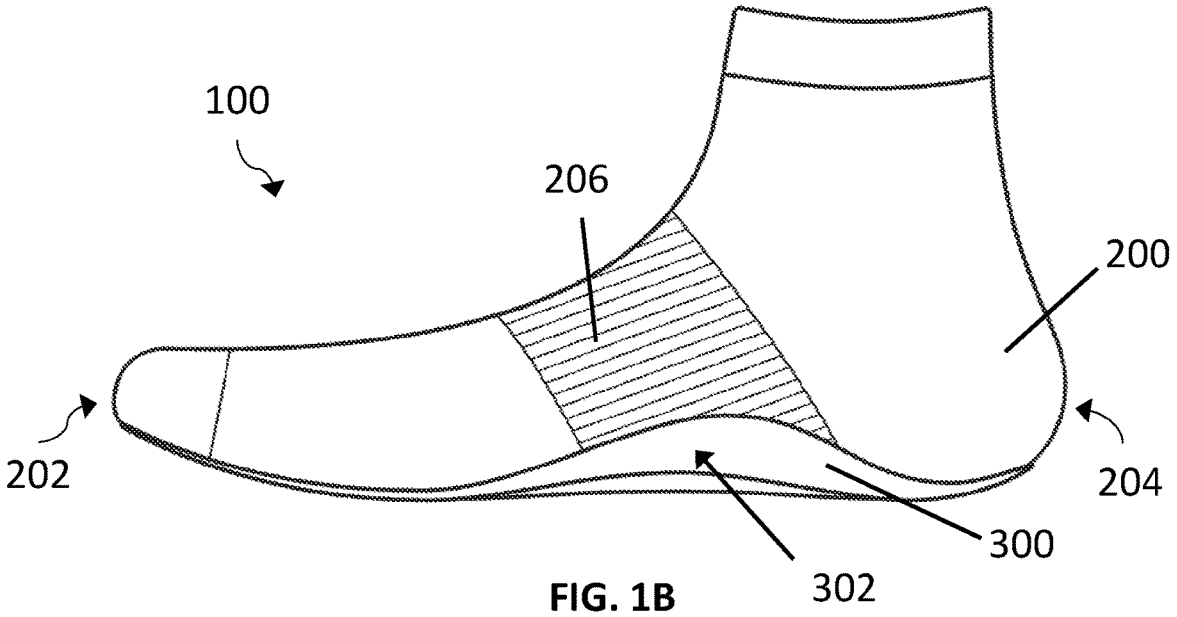
FIG. 1B illustrates a medial view of the exemplary footwear device shown in FIG. 1A.
Figure 1C:
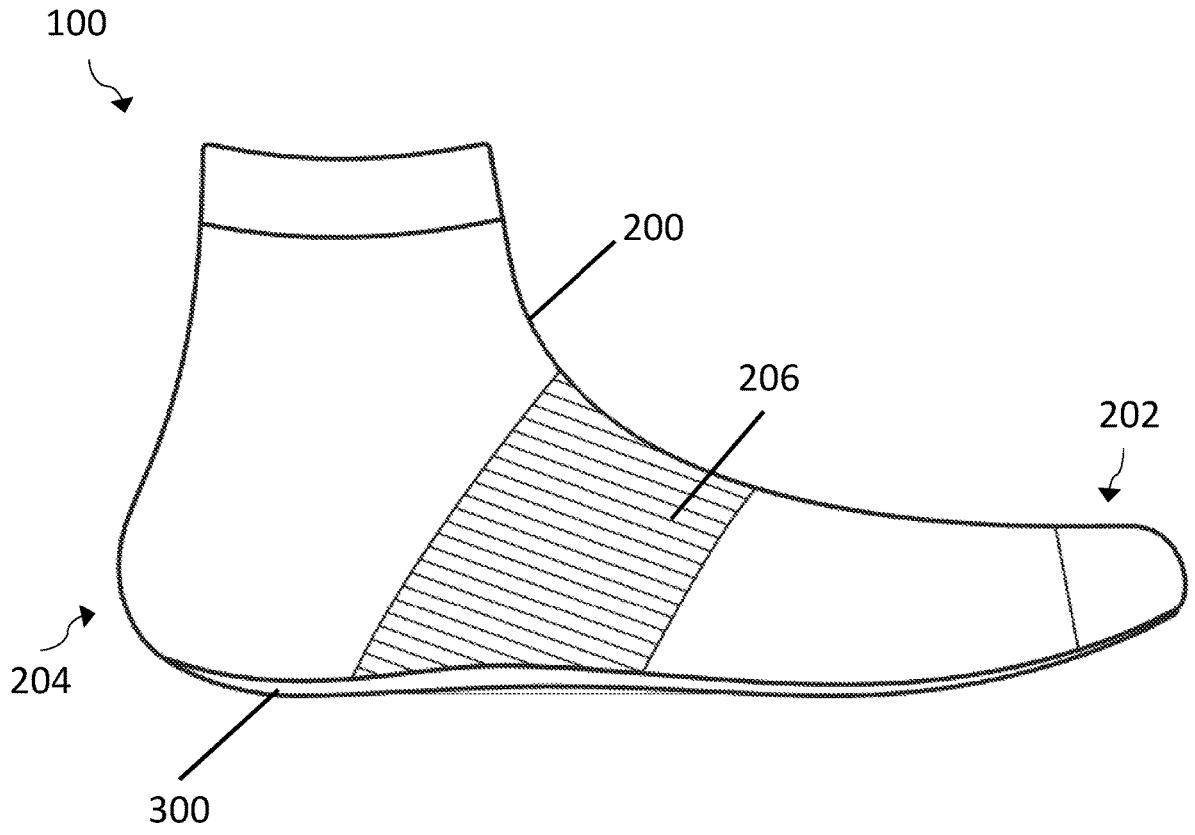
FIG. 1C illustrates a lateral view of the exemplary footwear device shown in FIGS. lA and 1B.

FIGS. 1A-1C illustrate an exemplary footwear device 100 configured in accordance with some embodiments of the subject disclosure. The footwear device 100 illustrated in FIGS. 1A-1C is formed to accommodate a right foot but, in other embodiments, may be formed to accommodate a left foot. FIG. 1A illustrates an exploded perspective view of footwear device 100, FIG. 1B illustrates a medial side view of footwear device 100, and FIG. 1C illustrates a lateral side view of footwear device 100. FIG. 1A illustrates outer sock 200 and anatomical sole 300 of footwear device 100. As shown in FIGS. 1A-1C, outer sock 200 includes a toe area 202 and an opposing heel area 204. Outer sock 200 may be formed of a knitted or otherwise woven material. In some embodiments, outer sock 200 is formed of cotton, wool, synthetic, or blended fibers. In these and other embodiments, outer sock 200 includes seamless toe stitching and a no-slip tab in the heel for greater comfort.

As shown in FIGS. 1A-1C, anatomical sole 300 is attached to an external bottom surface of the outer sock 200. As used herein, the term "anatomical" refers to the shape of sole 300 and, in particular, to elements of its structure that mirror the anatomical features of a human foot. For example, anatomical sole 300 may be shaped to include a raised arch support region 302 (illustrated in FIGS. 1A and 1B). Anatomical sole 300 may be formed of any suitable material, including polymeric materials or non-polymeric materials. In some embodiments, anatomical sole 300 may be formed of natural or synthetic rubber, carbon rubber, silicone, and/or thermoplastic polyurethane (TPU).

In some embodiments, anatomical sole 300 may include a plurality of apertures extending from a top surface of the sole through to a bottom surface of the sole. However, in other embodiments, anatomical sole 300 may not include any apertures and may instead be formed of a solid, monolithic material. FIGS. 1A-1C illustrate an exemplary anatomical sole 300 without apertures and FIGS. 2A-2D illustrate an exemplary anatomical sole 300 that includes a plurality of apertures 304. Regardless of whether anatomical sole 300 includes apertures 304 or not, anatomical sole 300 may have a non-uniform thickness. Additionally, in these and other embodiments, the anatomical sole 300 may be configured with negative area under particular regions to provide flex and also facilitate use with other footwear (e.g., shoes or boots).

Figure 2A:
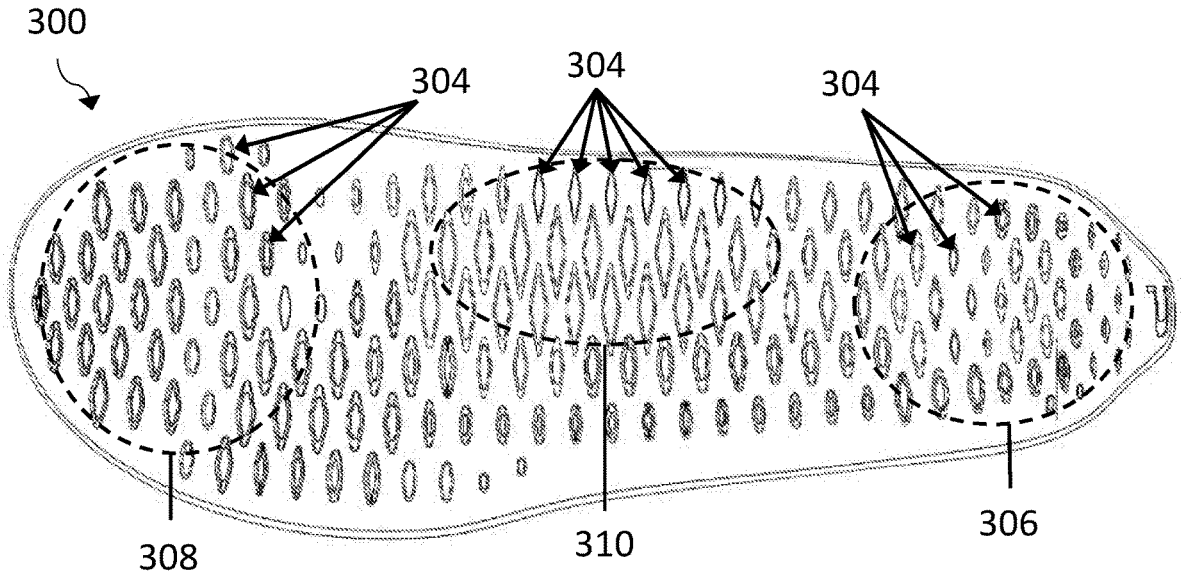
FIG. 2A illustrates a bottom view of an exemplary anatomical sole, in accordance with some embodiments of the subject disclosure.

FIG. 2A illustrates a bottom view of an exemplary anatomical sole 300 that includes a plurality of apertures 304 extending from a top surface of the anatomical sole through to a bottom surface of the anatomical sole. If present, some, all, or at least a portion of the plurality of apertures 304 may have a diamond-shaped cross-section. As used herein, the term "diamond" refers to any four-sided shape, either having angles greater than, less than, or equal to 90°. In some embodiments, at least a portion of the plurality of apertures 304 have unequal length, width, and/or depth dimensions. For example, some apertures 304 may be smaller and/or more shallow than other apertures 304. In specific embodiments, apertures in an arch region of the anatomical sole have a depth greater than apertures in another region of the anatomical sole (e.g., in the heel region or the toe region). In these and other embodiments, a front region of the anatomical sole 300 contains more apertures 304 than a rear region of the anatomical sole 300. FIG. 2A illustrates a particular aperture 304 configuration in which apertures are positioned in the heel region 306, toe region 308, and arch region 310 of anatomical sole 300.

Figure 2B:
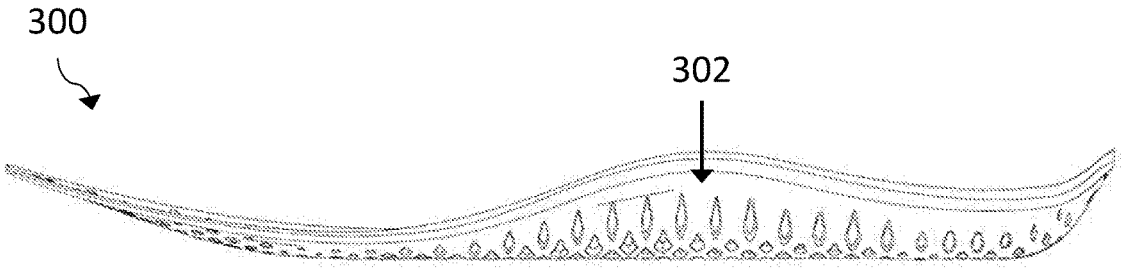
FIG. 2B illustrates a medial view of the exemplary anatomical sole shown in FIG. 2A.
Figure 2C:
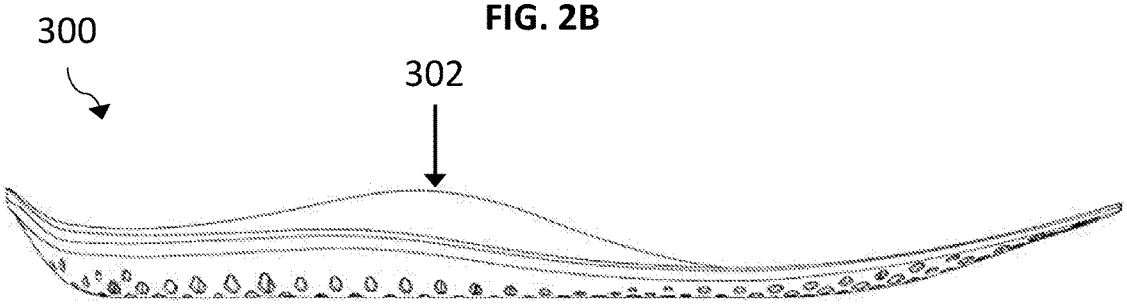
FIG. 2C illustrates a lateral view of the exemplary anatomical sole shown in FIGS. 2A and 2B.
Figure 2D:
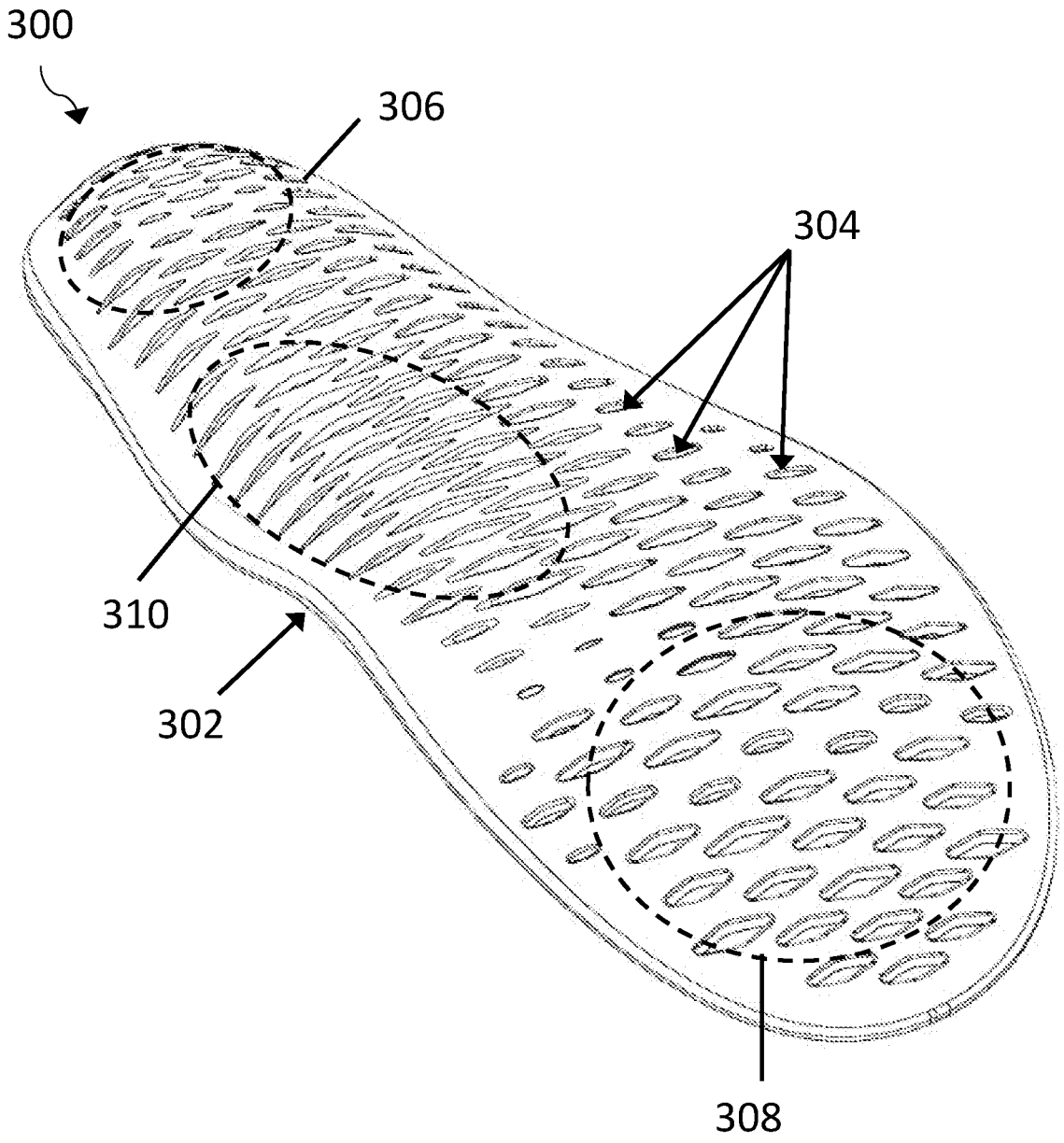
FIG. 2D illustrates a perspective view of the exemplary anatomical sole shown in FIGS. 2A-2C.

The anatomical sole 300 may be shaped in any desired manner to fully support the physical features of a human foot. Accordingly, in some embodiments, anatomical sole 300 may have a non-uniform thickness (i.e., thinner in some regions and thicker in other regions, to provide support and flexibility, as needed). FIG. 2B illustrates a medial view of the anatomical sole 300 shown in FIG. 2A, FIG. 2C illustrates a lateral view of the same anatomical sole 300, and FIG. 2D illustrates a perspective view of the anatomical sole 300. Although the anatomical sole 300 shown in FIGS. 2A-2D is shaped for a right foot, anatomical sole 300 may alternatively be shaped for a left foot, in some embodiments. As illustrated in FIGS. 2A-2D, anatomical sole 300 may be shaped to curve upward along one or more of its edges. For example, in some embodiments, anatomical sole 300 may curve upward on a medial side and on a lateral side (see FIGS. 2B and 2C). In these and other embodiments, anatomical sole 300 may curve upward in heel region 306 to wrap around a heel area of outer sock 200. These curvature features of anatomical sole 300 may increase user comfort and support, as will be appreciated by those skilled in the art.

Anatomical sole 300 may be joined to outer sock 200 using any desired technique. For example, in some embodiments, the anatomical sole 300 may be attached to the outer sock 200 with gluing, stitching, and/or with high frequency sonic welding processes. In select embodiments, an adhesive may be used to join outer sock 200 to anatomical sole 300. However, in other embodiments, the anatomical sole 300 may be attached to the outer sock 200 without any adhesive. In some such embodiments, adhesion between outer sock 200 and anatomical sole 300 may be accomplished via directly molding anatomical sole 300 onto outer sock 200 while outer sock 200 is positioned on a molding device. Alternatively, anatomical sole 300 may be 3-D printed directly onto outer sock 200, in some embodiments. Numerous configurations and variations are possible and contemplated.

Outer sock 200 may be configured to have any desired specifications and, in some embodiments, outer sock 200 is knitted to include a region with increased compression relative to other regions of the outer sock. FIGS. 1A-1C illustrate a region of increased compression 206. As shown in FIGS. 1A-1C, the region of increased compression 206 may be located on a bottom middle surface of the outer sock 200 and may extend from a medial side to a lateral side of the outer sock 200. In some embodiments, the region of increased compression 206 extends fully around outer sock 200 while, in other embodiments, the region of increased compression 206 does not extend to an upper region of outer sock 200. If present, the region of increased compression 206 may be formed using a knitting technique to increase tension in the region or by any other suitable technique known in the art.

Figure 3:
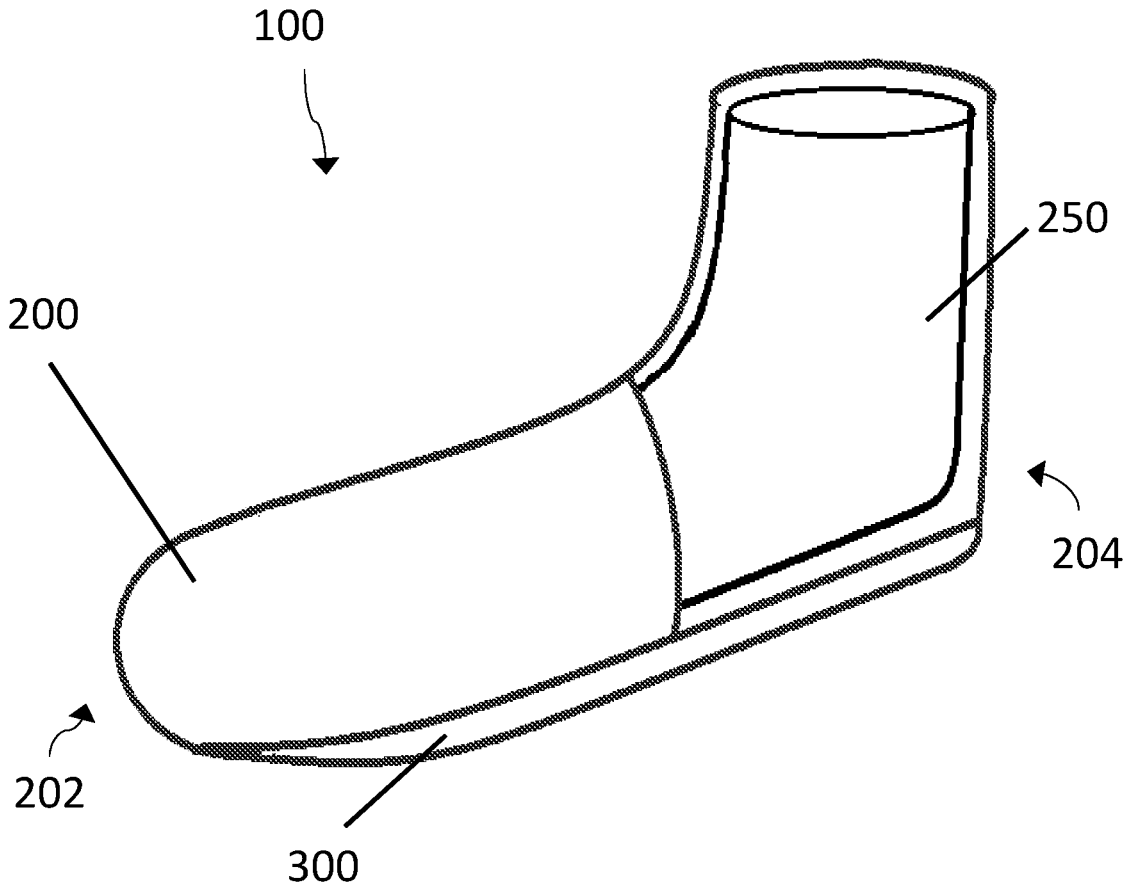
FIG. 3 illustrates a cut-away view of an exemplary footwear device having an inner sock, outer sock, and an attached anatomical sole, in accordance with some embodiments of the subject disclosure.

In select embodiments, footwear device 100 includes an inner sock in addition to outer sock 200. FIG. 3 illustrates a cut-away view of an exemplary footwear device 100 having an inner sock 250 positioned inside outer sock 200 with an attached anatomical sole 300. Inner sock 250 may have any features previously described with respect to outer sock 200. For example, inner sock 250 may be formed of a knitted material and may, in select embodiments, be knitted concurrently with outer sock 200 using a circular knitting technique.

If present, inner sock 250 may be adhered to outer sock 200 in one or more regions. For example, in select embodiments, a toe area of the inner sock 250 is fastened to the toe area 202 of the outer sock 200. In these and other embodiments, the heel area of the inner sock 250 may be fastened to the heel area 204 of the outer sock 200. In some cases, an adhesive and/or stitching may be used to fasten the toe area of the inner sock 250 to the toe area 202 of the outer sock 200 and/or to fasten the heel area of the inner sock 250 to the heel area 204 of the outer sock 200.

Footwear device 100 may include additional layers, as desired. For example, in some embodiments, footwear device 100 also includes a cushion layer positioned between outer sock 200 and inner sock 250. In some such embodiments, the cushion layer extends from the toe area 202 to the heel area 204. In other embodiments, a cushion layer may be positioned between outer sock 200 and anatomical sole 300. If present, the cushion layer may be continuous or may include one or more apertures formed therein.

In some embodiments, footwear device 100 may include a waterproof membrane. In some such embodiments, the waterproof membrane may be positioned between the outer sock 200 and the anatomical sole 300. The waterproof membrane may be configured to wick moisture away from a foot contained inside the footwear device 100 while also repelling external liquids and preventing liquids from dampening outer sock 200 (and inner sock 250, if present).

Exemplary Methods

Figure 4:
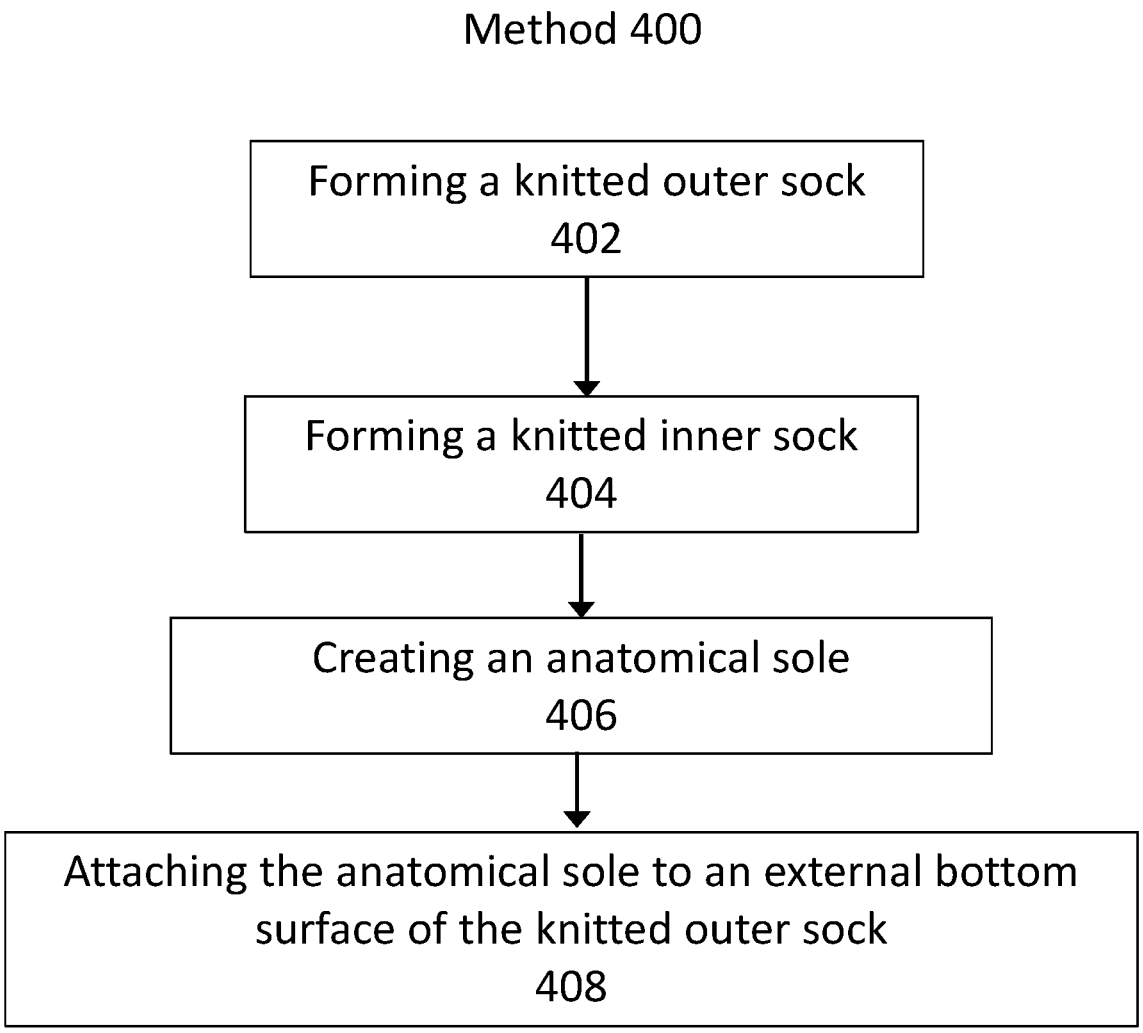
FIG. 4 illustrates an exemplary method of producing a footwear device having an outer sock and an anatomical sole, in accordance with some embodiments of the subject disclosure.

FIG. 4 illustrates an exemplary method 400 of producing a footwear device 100, as described herein. In method 400, each block represents a module, segment, process, or step, which comprises one or more actions for implementing the specified function. It should be noted that the functions noted in the blocks of FIG. 4 may occur in the order illustrated or in an alternative order. For example, in some embodiments, the functions of the blocks may be illustrated in the order illustrated, in the reverse order illustrated, or concurrently.

As shown in FIG. 4, method 400 includes forming a knitted outer sock 200 (block 402). Method 400 continues with forming a knitted inner sock 250 (block 404). It will be appreciated that any techniques and methods described herein with respect to outer sock 200 and inner sock 250 may be used to form the knitted inner sock and outer sock (blocks 402 and 404). Method 400 continues with creating an anatomical sole 300 (block 406). As will be understood, anatomical sole 300 may be formed to have any features previously described herein (e.g., anatomical sole 300 may have a raised arch support region, a non-uniform thickness, and may be shaped to curve upward in a heel area, on a medial side, and/or on a lateral side). Method 400 concludes with attaching the anatomical sole 300 to an external bottom surface of the knitted outer sock 200 (block 408).

In some embodiments, method 400 also includes injection molding the anatomical sole 300 and subsequently attaching the anatomical sole 300 to the knitted outer sock 200 with an adhesive. However, in other embodiments, method 400 includes direct molding the anatomical sole 300 onto the outer knitted sock 200 while the outer knitted sock 200 is positioned on a mold. In yet another embodiment, method 400 includes 3-D printing the anatomical sole 300 onto the outer sock 200 using measurements from a foot scan. In any of these embodiments, method 400 may also include knitting the inner sock 250 concurrently with the outer sock 200 using a circular knitting technique.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes, and not to limit the scope of the inventive subject matter described herein. The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The invention claimed is:

1. A footwear device comprising:

an outer sock having a toe area and an opposing heel area and a bottom surface, wherein the outer sock consists of a knitted or woven material; and an anatomical sole attached to an external bottom surface of the outer sock, wherein the anatomical sole includes a raised arch support region and comprises a plurality of unobstructed apertures extending from the bottom surface of the outer sock through a bottom surface of the footwear device.

2. The footwear device of claim 1, wherein at least a portion of the plurality of apertures have a diamond-shaped cross-section.

3. The footwear device of claim 1, wherein at least a portion of the plurality of apertures have unequal length, width, and/or depth dimensions.

4. The footwear device of claim 1, wherein apertures in an arch region of the anatomical sole have a depth greater than apertures in another region of the anatomical sole.

5. The footwear device of claim 1, wherein a front region of the anatomical sole contains more apertures than a rear region of the anatomical sole.

6. The footwear device of claim 1, wherein the anatomical sole has a non-uniform thickness.

7. The footwear device of claim 1, wherein the anatomical sole wraps around at least a portion of the heel area of the outer sock.

8. The footwear device of claim 1, wherein the anatomical sole curves upward on a medial side and on a lateral side.

9. The footwear device of claim 1, wherein an adhesive joins the outer sock to the anatomical sole.

10. The footwear device of claim 1, wherein the anatomical sole is attached to the outer sock without adhesive.

11. The footwear device of claim 1, wherein the outer sock is knitted to include a region with increased compression relative to other regions of the outer sock and the region with increased compression is located on a bottom middle surface of the outer sock, extending from a medial side to a lateral side of the outer sock.

12. The footwear device of claim 1 further comprising an inner sock formed of a knitted material and positioned inside the outer sock, wherein a toe area of the inner sock is fastened to the toe area of the outer sock.

13. The footwear device of claim 12, wherein a heel area of the inner sock is fastened to the heel area of the outer sock.

14. The footwear device of claim 13, wherein an adhesive is used to fasten the toe area of the inner sock to the toe area of the outer sock and to fasten the heel area of the inner sock to the heel area of the outer sock.

15. The footwear device of claim 12 further comprising a cushion layer positioned between the outer sock and the inner sock and extending from the toe area to the heel area.

16. The footwear device of claim 1 further comprising a waterproof membrane positioned between the outer sock and the anatomical sole and extending from the toe area to the heel area.

17. The footwear device of claim 1, wherein the anatomical sole is formed of natural or synthetic rubber, silicone, and/or thermoplastic polyurethane (TPU).

18. A footwear device comprising:

an outer sock having a toe area and an opposing heel area, wherein the sock is formed of a knitted material;

an inner sock formed of a knitted material and positioned inside the outer sock; and an anatomical sole attached to an external bottom surface of the outer sock, wherein the anatomical sole includes a raised arch support and wraps around at least a portion of the heel area of the outer sock and curves upward on a medial side and on a lateral side.

19. The footwear device of claim 18, wherein the anatomical sole has a non-uniform thickness and does not comprise any apertures.

20. The footwear device of claim 18, wherein a toe area of the inner sock is fastened to the toe area of the outer sock and a heel area of the inner sock is fastened to the heel area of the outer sock.

21. The footwear device of claim 18, wherein the outer sock is knitted to include a region with increased compression relative to other regions of the outer sock and the region with increased compression is located on a bottom middle surface of the outer sock, extending from a medial side to a lateral side of the outer sock.

22. A method of producing a footwear device, the method comprising:

forming a knitted outer sock;

forming a knitted inner sock;

creating an anatomical sole having a raised arch support, a non-uniform thickness, and shaped to curve upward in a heel area, on a medial side, and on a lateral side; and attaching the anatomical sole to an external bottom surface of the knitted outer sock.

23. The method of claim 22 further comprising injection molding the anatomical sole and subsequently attaching the anatomical sole to the knitted outer sock with an adhesive.

24. The method of claim 22 further comprising direct molding the anatomical sole onto the outer knitted sock while the outer knitted sock is positioned on a mold.

25. The method of claim 22 further comprising 3-D printing the anatomical sole based on measurements from a foot scan.

26. The method of claim 22 further comprising knitting the inner sock concurrently with the outer sock using a circular knitting technique.

* * * * *